United States Patent [19]

Lahr

[11] Patent Number: 4,846,044

[45] Date of Patent: Jul. 11, 1989

[54] PORTABLE SELF-DEFENSE DEVICE

[76] Inventor: Roy J. Lahr, 944 Hammond St., Los Angeles, Calif. 90069

[21] Appl. No.: 142,734

[22] Filed: Jan. 11, 1988

[51] Int. Cl.[4] ..... F41B 15/04

[52] U.S. Cl. ..... 89/1.11; 42/108; 222/79; 361/232

[58] Field of Search ..... 89/1.11; 273/84 ES; 222/79, 135, 389; 42/1.08, 103, 84; 361/232

[56] References Cited

U.S. PATENT DOCUMENTS

| | | | |
|---|---|---|---|
| 2,249,608 | 7/1941 | Greene | 222/79 |
| 2,253,315 | 8/1941 | Andrus | 273/84 ES |
| 3,374,708 | 3/1968 | Wall | 89/1.11 |
| 3,971,292 | 7/1976 | Paniagua | 89/1.11 |
| 4,223,804 | 9/1980 | Morris et al. | 42/1.08 |
| 4,486,807 | 12/1984 | Yanez | 273/84 ES |
| 4,765,510 | 8/1988 | Rende | 222/79 |

*Primary Examiner*—Deborah L. Kyle
*Assistant Examiner*—Michael J. Carone
*Attorney, Agent, or Firm*—Rohm & Monsanto

[57] ABSTRACT

A non-lethal self defense device which applies a disabling electric shock to personnel desired to be disabled employs fluid cartridges for containing an electrically conductive fluid. The fluid cartridges each have a reservoir for holding electrically conductive fluid and a nozzle through which is expelled the electrically conductive fluid during operation of the device. A compressed gas cartridge supplies the force required for expelling the electrically conductive fluid as a pair of continuous streams. The cartridges are supported by a frame whereby the nozzle portions of the two of the fluid cartridges are aimed in substantially the same direction. A displaceable linkage responsive to release of the compressed gas from the gas cartridge causes the electrically conductive fluid to be expelled. An electrification system, which may include an oscillator and coil arrangement powered by a standard battery, supplies electrical energy to the streams of electrically conductive fluid. Additives such as dyes, irritants, and odoriferous substances may be included with the electrically conductive fluid. Also, a lighting system can be used to identify the assailant and assist in aiming the device.

16 Claims, 3 Drawing Sheets

PORTABLE SELF-DEFENSE DEVICE

BACKGROUND OF THE INVENTION

This invention relates generally to devices and systems for use in self-defense, and more particularly, to non-lethal self-defense devices which are used to disable an attacker at a distance by delivering to the attacker a disabling amount of electrical energy.

The prior art is well aware of the need to provide individuals with an effective, reliable, and non-lethal capacity for self-defense. It is known to be highly desirable that such a self-defense capability be effective at a distance, in the hope of avoiding a hand-to-hand situation. In the event, however, that the capacity of the self-defense device to operate at a distance is exhausted, it would also be desirable for the device to have significant and effective self-defense capability in the hand-to-hand range. Is also highly desirable for a self-defense device to be quickly and easily reloadable so that it can readily be made operative. None of the prior art arrangements satisfy the recognized needs.

One self-defense system which has gained acceptance with law enforcement agencies delivers to a would-be attacker a disabling electrical jolt conducted via wiring which is attached to dart-like projectiles and deployed during flight. Once contact is made with the body of the attacker, the electric signal conducted via the deployed wiring serves to disable the attacker. This arrangement is subject to a variety of disadvantages. First, the system is complex, therefore somewhat unreliable, and not easily reloaded. Moreover, contact must be made with the body of an attacker, and such contact may be prevented by heavy clothing. If the attacker can deflect the projectile or cut the wiring, or if the user of the device misses the first shot, there is not an opportunity to reaim and refire the device or reload same. In such eventuality, the device becomes useless and the user must rely on other weaponry.

Some of the disadvantages of the aforementioned system are overcome by the electrical anti-personnel weapon described in U.S. Pat. No. 3,374,708. This known device utilizes continuous streams of electrically conductive fluid to complete an electrical circuit with the body of the would-be attacker. It is a problem with this known system that it is quite bulky, requiring the user to carry a somewhat pistol-shaped apparatus having two pressurized tanks coupled thereto by fluid lines, and a separate battery pack with transformer coil circuitry coupled thereto by a cable harness. Although the arrangement is portable insofar as it can be operated in the field without connection to electrical mains, it cannot be carried discreetly, or concealed, and it is not easily reloadable without compressor equipment.

It is, therefore, an object of this invention to provide simple and economical non-lethal self-defense device.

It is another object of this invention to provide a nonlethal self-defense device which has greater effective range than conventional devices.

It is also an object of this invention to provide a nonlethal self-defense device which can be used with greater accuracy than conventional devices.

It is a further object of this invention to provide a self-defense device which is mechanically and electrically simple, and highly reliable.

It is additionally an object of this invention to provide a non-lethal self-defense device which quickly can be reloaded.

It is yet a further object of this invention to provide a multipurpose electrical defense weapon which can be used by choice to deter hostile activity at a distance, or at hand-to-hand range.

It is also another object of this invention to provide a non-lethal self-defense device which is both, effective and highly portable.

It is yet an additional object of this invention to provide a non-lethal self-defense device which is sufficiently small and light in weight to be concealable.

SUMMARY OF THE INVENTION

The foregoing and other objects are achieved by this invention which provides in one aspect thereof, an electrical anti-personnel device for deterring hostile activity on the part of personnel. In accordance with the invention, first and second reservoir cartridges are provided, each for containing a predetermined amount of an electrically conductive fluid. Each of the reservoir cartridges has a reservoir portion for holding a respective predetermined amount of the electrically conductive fluid and a nozzle portion through which is expelled the electrically conductive fluid contained in the reservoir portion. An activation cylinder is provided having an activation piston disposed therein, the activation piston being in substantially sealing sliding communication with the interior of the activation cylinder. A pressurizing arrangement urges a pressurized fluid into the activation cylinder whereby the activation piston is displaced responsively along the interior of the activation cylinder. First and second expulsion pistons are arranged in substantially sealing sliding communication with the interior of a respectively associated one of the first and second reservoirs. A coupling arrangement couples the activation piston to each of the expulsion pistons, whereby displacement of the activation piston in the activation cylinder in response to the pressurizing arrangement causes the electrically conductive fluid to be expelled in the form of a ballistic, continuous stream from the nozzle portion of each of the reservoir cartridges. An efficacious electrical potential is applied to the continuous stream of expelled electrically conductive fluid by an electrification system which, in one embodiment of the invention, is coupled to the nozzle portion of each reservoir cartridge.

In a preferred embodiment of the invention, the pressurizing arrangement includes a pressurized gas cartridge having a compressed gas therein. A penetrating point is provided for opening the pressurized gas cartridge whereby the compressed gas is released and urged into the activation cylinder. In other embodiments there is additionally provided an electrical switch for activating the electrification system. The electrical switch is arranged to be operable to activate the electrification system substantially simultaneously with the expulsion of the electrically conductive fluid. The switch, in a practical embodiment of the invention, couples a battery to the electrification system.

In a further embodiment of the invention, the pressurizing arrangement includes a coiled spring which applies pressure against a capturing bail. Such a spring arrangement can be recompressed after usage, thereby obviating the need for maintaining a stock of replacement pressurized gas cartridges.

The electrification system itself may be formed of high voltage converter circuitry for converting a relatively low voltage, such as that produced by a conventional battery, into a higher voltage having sufficient magnitude and power to deter personnel. A conductive circuit applies the higher voltage to the electrically conductive fluid.

In accordance with a highly advantageous aspect of the invention, a pair of conductive protrusions are arranged in the vicinity of the nozzle portions of the reservoir means and coupled electrically to the electrification system for enabling use of the device while in direct communication with the personnel to be disabled. In some embodiments, the conductive protrusions are extensions of the nozzle portions of the reservoir cartridges themselves, thereby simplifying the overall construction of the device. Using these protrusions, the device can be used as a conventional stun gun when necessary in the hand-to-hand range. Thus, the device retains a defense capability notwithstanding exhaustion of the electrically conductive fluid.

In practice, the nozzle portions of the reservoir cartridges are aimed to prevent the electrically conductive fluid expelled in the form of a stream from the nozzle portions of the reservoir means to communicate with one another within the usable range of the device. Preferably, the electrified streams should diverge slightly from one another, thereby ensuring that the electrical circuit is completed by the personnel to be disabled.

It is to be understood that although the present invention is particularly suited for high portability, many of the advantages of the invention are available in situations where the protective device is installed in a fixed location. In such situations, the protective device of the present invention can be mounted in a manner where it protects a vulnerable area, or potential point of entry for an assailant, such as a window or door.

During storage of a specific illustrative embodiment of the device, leakage of the electrically conductive fluid through the nozzle portions of the reservoir cartridges is prevented by the use of blocking caps or stoppers. Preferably, the blocking caps or stoppers are applied in a manner whereby the force of the electrically conductive fluid being expelled will remove same. This avoids the need for the user to remember to uncap or unstop the nozzle portions prior to use. In practice, it may be desirable to use stoppers so as to avoid covering the nozzles which, as indicated, also serve as electrodes for use of the device as a close encounter stun gun.

In a particularly advantageous embodiment of the invention, the electrically conductive fluid in at least one of the reservoir cartridges contains a marking dye. Such a marking dye may be a fluorescent dye, such as fluorescene, a coal tar derivative, or may be a visible dye. This will facilitate recognition of the personnel by authorities should the assailant be repelled and escape. In addition, the electrically conductive fluid in at least one of the reservoir cartridges may contain an odoriferous agent for marking the personnel, or an irritating agent for enhancing disablement of the personnel. The odoriferous agent may be peridene, and the irritating agent may be any of several known substances, such as Mace fluid, typically CS or CN.

In most situations, there probably will remain a supply of compressed gas after the electrically conductive fluid is totally expelled. The remaining pressurized gas can be coupled to an alarm for emitting an alarming sound. This, of course, will serve to alert others to the imminent or ongoing attack, and can be used to summon assistance.

In accordance with another aspect of the invention, the device employs fluid cartridges, each for containing a predetermined amount of the electrically conductive fluid. The fluid cartridges have a reservoir portion for holding the predetermined amount of the electrically conductive fluid and a nozzle portion through which is expelled the electrically conductive fluid. Additionally, a gas cartridge is utilized for containing a pressurized gas. The device is supported by a frame having a first portion for accommodating removeably in predetermined spaced relationship at least two of the fluid cartridges, whereby the nozzle portions of the two of the fluid cartridges are directed in substantially the same direction. Additionally, there is provided a second portion for accommodating at least one gas cartridge. A displaceable linkage responsive to release of the compressed gas from the gas cartridge causes the electrically conductive fluid to be expelled from the two fluid cartridges substantially simultaneously in the form of a pair of streams from respective nozzle portions of the fluid cartridges. As described hereinabove, an electrification system supplies the disabling electrical energy to the streams of electrically conductive fluid. The use of replaceable cartridges permits easy reloading of the device without need of maintaining bulky and potentially dangerous supplies.

Actuation of the device so as to cause the electrically conductive fluid to be expelled is achieved by use of a displaceable linkage having a first portion for communicating with the compresses gas, and second and third portions for communicating with respective ones of the two fluid cartridges. In a specific illustrative embodiment of the invention, the second and third portions are displaceable in response to forces applied thereto from the release of the compressed gas, and have respective plunger members for urging the electrically conductive fluid through the nozzle portions. Release of the compressed gas is effected illustratively by a piercing point which, when it is desired to use the device, penetrates the gas cartridge.

In a further specific embodiment of the invention, a lighting system can be used to identify the assailant, and also to assist in aiming the device, particularly in the dark. Additionally, the lighting system serves to disguise the device in the dark as a flashlight, thereby affording the user at least some of the benefits of the element of surprise.

BRIEF DESCRIPTION OF THE DRAWING

Comprehension of the invention is facilitated by reading the following detailed description in conjunction with the annexed drawing, in which.

DETAILED DESCRIPTION

Figure 1:
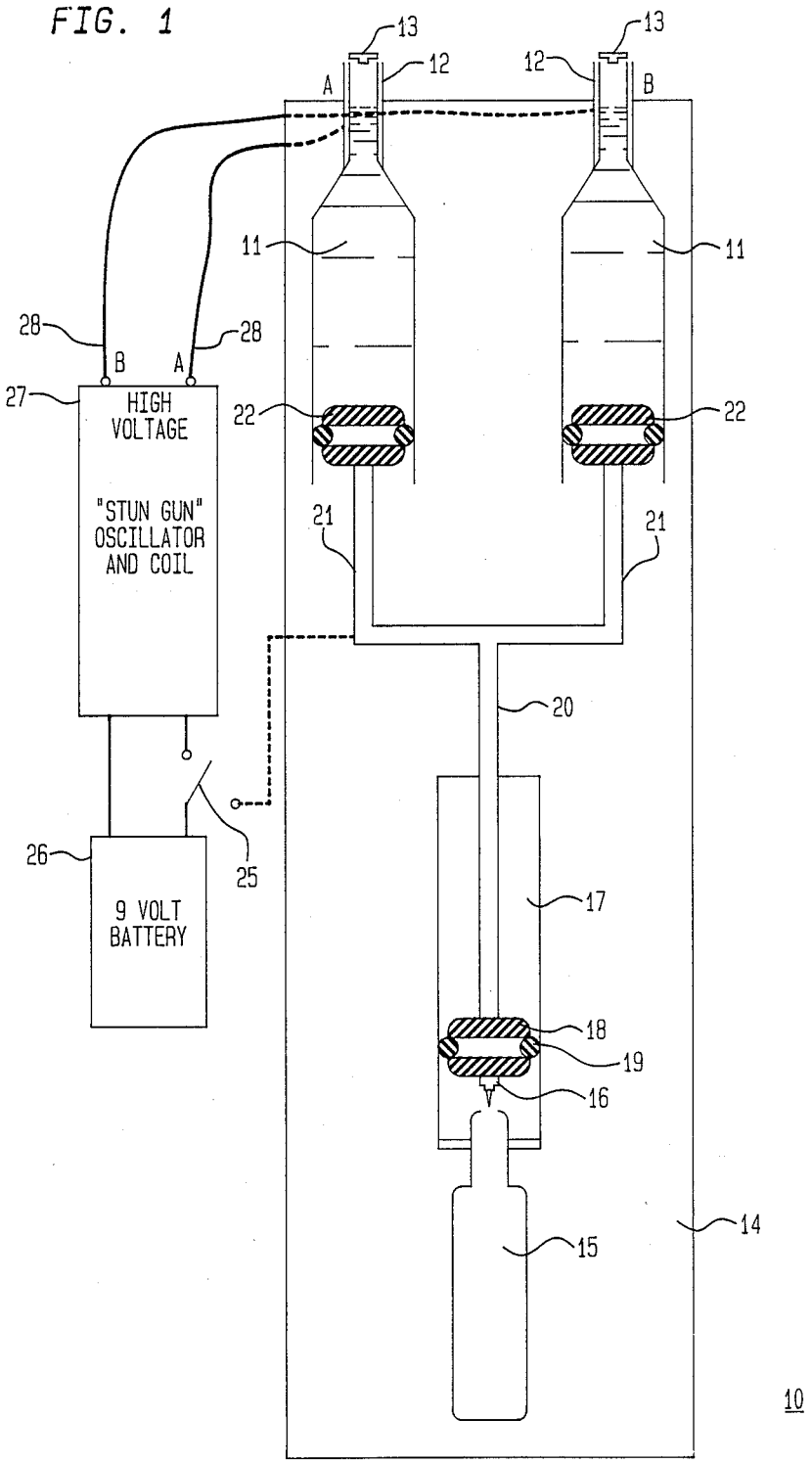
FIG. 1 is a schematic representation of a specific illustrative embodiment of the invention which utilizes a pressurized gas cartridge.

FIG. 1 is a schematic representation of a specific illustrative embodiment of a self-defense apparatus 10 constructed in accordance with the principles of the invention. As shown, self-defense apparatus 10 is provided with a pair of cartridges 11 which are filled with an electrically conductive fluid, illustrated by the stippling. Preferably, at least nozzle portions 12 of cartridges 11 are formed of an electrically conductive material such that electrical communication is made between nozzle portions 12 and the electrically conductive fluid. In this specific embodiment, nozzle portions 12 are sealed by nozzle stoppers 13. The nozzle stoppers prevent leakage of the electrically conductive fluid and are configured to be self-removable upon actuation of the apparatus.

The energy for expelling the electrically conductive fluid from cartridges 11 is obtained from a pressurized gas cartridge 15. Actuation of self-defense apparatus is effected by perforating the casing of pressurized gas cartridge 15, illustratively with a perforating point 16. Once such perforation is achieved, the compressed gas in pressurized gas cartridge 15 escapes into an actuation cylinder 17, thereby causing an actuator piston 18 to be urged along the actuation cylinder. Actuator piston 18 is arranged in the actuation cylinder so as to maintain a seal while sliding therealong. Such a seal is maintained, in this embodiment, by an O-ring 19 which is in sealing engagement with actuator piston 18 and the interior wall of actuation cylinder 17.

As shown in the drawing, cartridges 11 and pressurized gas cartridge 15 are arranged on a support frame 14, shown schematically in the drawing. Support frame 14 functions as a base plate and ensures that the predetermined spaced relationship is maintained between the various elements of the apparatus.

An actuation linkage 20 is coupled to actuator piston 18 and is moved responsively therewith. As shown in this schematic representation, actuation linkage 20 is coupled to a pair of plungers 21 which drive fluid expulsion pistons 22. The fluid expulsion pistons are in sealing engagement with the interior walls of cartridges 11, and in certain embodiments, are supplied therewith. By operation of this drive system, fluid expulsion pistons 22 apply a pressurizing force to the electrically conductive fluid which causes nozzle stoppers 13 to be ejected and the electrically conductive fluid expelled as a continuous stream out of nozzle portions 12.

In this embodiment, perforating point 16 is secured to the interior wall of actuation cylinder 17 in a nonsealing manner. Thus, pressurized gas cartridge 15 can be urged into contact with the perforating point by any known means. Once such contact is made sufficient to penetrate the pressurized gas cartridge, the compressed gas will cause the actuator piston to move, as described hereinabove. Also in this specific embodiment, actuation linkage 20 is mechanically coupled to an electrical switch 25 which couples a battery 26 to an electrification circuit 27. The application of an energizing potential to electrification circuit 27 in response to actuation linkage 20 causes a substantially high voltage to be produced at electrical terminals 28, which are electrically coupled to nozzle portions 12. Thus, the electrically conductive fluid streams which are emitted during operation of self-defense apparatus 10 bear a disablingly high voltage with respect to each other.

Figure 2:
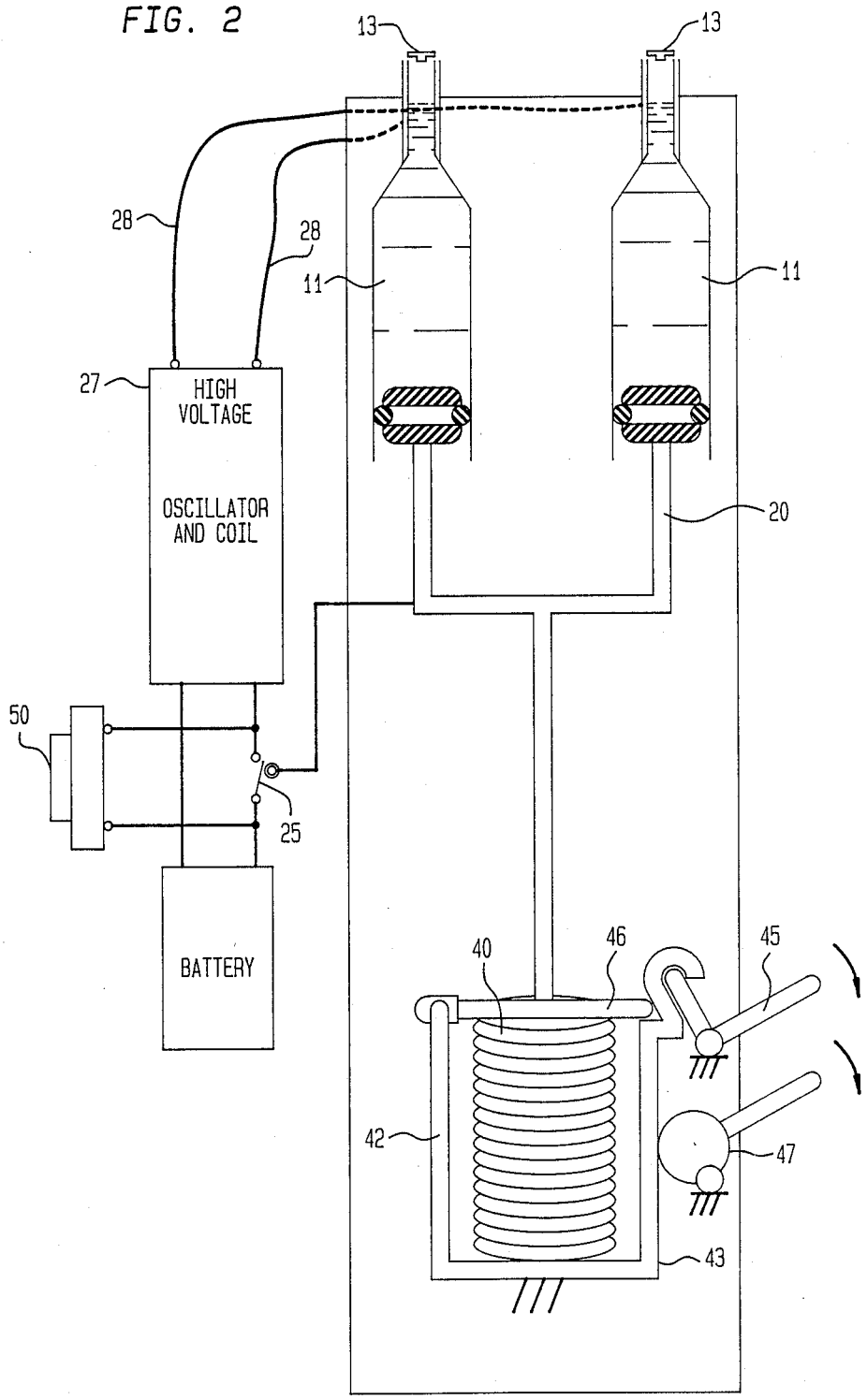
FIG. 2 is a schematic representation of a specific illustrative embodiment of the invention wherein the pressurizing force is obtained from a coiled spring.

FIG. 2 is a schematic representation of an embodiment of the invention wherein a pressurizing force is obtained from energy stored in a coiled spring. Elements of structure illustrated in FIG. 2 having analogous correspondence to elements discussed with respect to FIG. 1, are similarly designated. In this specific embodiment, a coil spring 40 is compressed within a spring retainer frame 42. Coil spring 40 is retained in a compressed state by a latch bar 43, which is actuatable in response to manipulation of a trigger crank 45. Upon actuation of trigger crank 45, a release bar 46 is released, thereby permitting coil spring 40 to exert a force on actuation linkage 20.

In this specific embodiment, accidental actuation of the device is prevented by a safety cam 47 having first and second states. When safety cam 47 is in a first state, it bears against latch bar 43, preventing release of release bar 46. When in its second state, latch bar 43 is permitted to be released upon manipulation of trigger crank 45. Also in this embodiment, an override switch 50 is provided to allow energization of electrification circuit 27. In this manner, the system can be operated as a stun gun, without discharging the electrically conductive fluid in cartridges 11. When used in this manner, it is preferred that nozzle stoppers 13 be formed of an electrically conductive material, illustratively conductive rubber.

Figure 3:
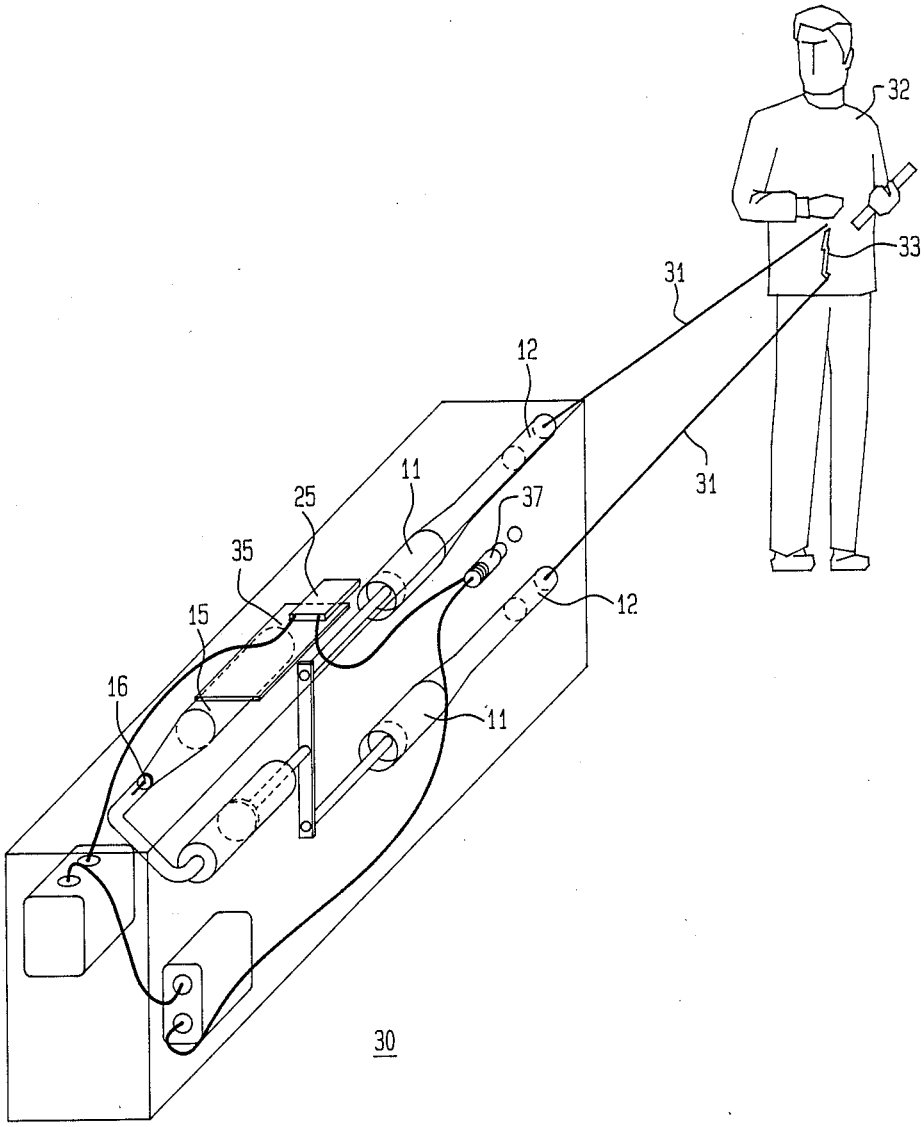
FIG. 3 is a partially fragmented isometric representation of another specific illustrative embodiment of the invention.

FIG. 3 is a partially fragmented isometric representation of a specific illustrative embodiment of the invention. Elements of structure having analogous correspondence to elements discussed with respect to FIG. 1 are similarly designated.

In FIG. 3, a self-defense apparatus is shown to contain cartridges 11 with nozzle portions 12, which expel streams 31 of electrically conductive fluid at an assailant 32. The streams contact assailant 32 at an electrified zone 33 where an electrical circuit is completed. Such electrification disables assailant 32. Unlike known arrangements of the type which expel electrical wiring, the assailant cannot break the circuit formed by streams 31, even if he applies a weapon thereto. The streams can readily be moved across the body of the assailant so as to ensure that a sensitive region thereof can be contacted.

In this embodiment, self-defense apparatus 30 is provided with an actuator button 35 which serves the double purpose, when manipulated, of first causing the electrical circuit of electrical switch 25 to be closed, thereby energizing nozzle portions 12 electrically, and then urging pressurized gas cartridge 15, upon the application of greater force, into contact with perforating point 16. In this manner, self-defense apparatus 30 can be used as a conventional stun gun, without need of exhausting the electrically conductive fluid. Also, the closing of electrical switch 25 in this embodiment activates a lamp 37 which is arranged as a flashlight oriented to facilitate aiming of the device. The lamp can also periodically be used to perform a battery test.

Once the apparatus has been used, and the electrically conductive fluid and the compressed gas are exhausted, case 39 can be opened to expose the interior of the apparatus and facilitate replacement of cartridges 11 and pressurized gas cartridge 15. Such cartridges may be color-coded to identify them as having particular characteristics, illustratively to identify their contents and any additives added thereto.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are preferred to facilitate comprehension of the invention, and should not be construed to limit the scope thereof.

What is claimed is:

1. An electric anti-personnel device for deterring hostile activity on the part of personnel, the electric anti-personnel device comprising:

first and second reservoir means, each containing a predetermined amount of an electrically conductive fluid, each of said reservoir means having a reservoir portion for holding said predetermined amount of said electrically conductive fluid and a nozzle portion through which is expelled said electrically conductive fluid contained in said reservoir portion;

activation cylinder means having activation piston means disposed therein, said activation piston means being in substantially sealing sliding communication with the interior of said activation cylinder means;

container opener means arranged in fluid communication with said activation cylinder means;

pressurized fluid container means for containing a pressurized fluid therein, said pressurized fluid container means being displaceable so as to be brought into contact with said container opener means, said pressurized fluid thereby being released into said activation cylinder means whereby said activation piston means is displaced responsibly along the interior of said activation cylinder means;

first and second expulsion piston means each arranged in substantially sealing sliding communication with the interior of a respectively associated one of said first and second reservoir means;

coupling means for coupling said activation piston means to each of said expulsion piston means, whereby displacement of said activation piston means in said activation cylinder means in response to said pressurizing means causes said electrically conductive fluid to be expelled in the form of a stream from said nozzle portion of each of said reservoir means; and electrification means for supplying electrical energy to said stream from said nozzle portion.

2. The electrical anti-personnel device of claim 1 wherein said pressurized fluid container means comprises a pressurized gas cartridge having a compressed gas therein.

3. The electrical anti-personnel device of claim 1 wherein there is further provided switch means for activating said electrification means.

4. The electrical anti-personnel device of claim 3 wherein said switch means is arranged to be operable to activate said electrification means substantially simultaneously with said expulsion of said electrically conductive fluid.

5. The electrical anti-personnel device of claim 1 wherein said electrification means comprises:

high voltage converter circuitry for converting a relatively low voltage into a higher voltage having a capability to deter personnel; and conductive means for applying said higher voltage to said electrically conductive fluid.

6. The electrical anti-personnel device of claim 5 wherein there is further provided battery means for providing said relatively low voltage.

7. The electrical anti-personnel device of claim 1 wherein there is further provided conductive protrusion means arranged in the vicinity of said nozzle portions of said reservoir means and coupled electrically to said electrification means, for facilitating direct communication with the personnel.

8. The electrical anti-personnel device of claim 7 wherein said conductive protrusion means are extensions of said nozzle portions of said reservoir means.

9. The electrical anti-personnel device of claim 1 wherein said nozzle portions of said reservoir means are aimed to cause said electrically conductive fluid expelled in the form of a stream from said nozzle portions of said reservoir means to diverge from one another.

10. The electrical anti-personnel device of claim 1 wherein there is further provided blockage means arranged on said nozzle portions of said reservoir means for preventing leakage of said electrically conductive fluid.

11. The electrical anti-personnel device of claim 1 wherein said electrically conductive fluid in at least one of said reservoir means contains a marking dye.

12. The electrical anti-personnel device of claim 1 wherein said electrically conductive fluid in at least one of said reservoir means contains a an odorless odoriferous agent for marking the personnel.

13. The electrical anti-personnel device of claim 1 wherein said electrically conductive fluid in at least one of said reservoir means contains an irritating agent for enhancing disablement of the personnel.

14. A self-defense arrangement for disabling an assailant being, the arrangement comprising:

fluid cartridge means for containing a predetermined amount of an electrically conductive fluid, said fluid cartridge means having a reservoir portion for holding said predetermined amount of said electrically conductive fluid and a nozzle portion through which is expelled said electrically conductive fluid;

gas cartridge means for containing a compressed gas;

frame means having a first portion for accomodating replaceably in predetermined spaced relationship at least two of said fluid cartridge means, whereby said nozzle portions of said two of said fluid cartridge means are directed in substantially the same direction, and a second portion for accomodating said gas cartridge means;

displaceable linkage means responsive to release of said compressed gas from said gas cartridge means for causing said electrically conductive fluid to be expelled from said two of said fluid cartridge means substantially simultaneously in the form of a stream from said nozzle portion of each of said fluid cartridge means, said displaceable linkage means being provided with a first portion for communicating with said compressed gas, and a pair of plunger members for communicating with respective ones of said two of said fluid cartridge means for urging said electrically conductive fluid through said nozzle portions; and electrification means for supplying electrical energy to said stream from said nozzle portion.

15. The self-defense arrangement of claim 14 wherein there is further provided piercing means for penetrating said gas cartridge means for releasing said compressed gas.

16. The self-defense arrangement of claim 14 wherein there is further provided light means for facilitating identification of the assailant being and aiming of the arrangement.

* * * * *